United States Patent [19]

Nagato

[11] Patent Number: 4,606,767

[45] Date of Patent: Aug. 19, 1986

[54] DECORATIVE SILVER-COLORED SINTERED ALLOY

[75] Inventor: Yoshio Nagato, Kokubu, Japan

[73] Assignee: Kyocera Corporation, Kyoto, Japan

[21] Appl. No.: 791,940

[22] Filed: Oct. 28, 1985

[30] Foreign Application Priority Data

Oct. 30, 1984 [JP] Japan ..... 59-229894

[51] Int. Cl.[4] ..... C22C 29/02

[52] U.S. Cl. ..... 75/242; 75/236; 419/15; 419/38; 419/57; 419/60; 420/451

[58] Field of Search ..... 75/236, 242; 420/451; 419/15, 38, 57, 60

[56] References Cited

U.S. PATENT DOCUMENTS 1,961,468 6/1934 Walter ..... 419/15 X
2,765,227 10/1956 Goetzel et al. ..... 419/15 X
3,552,937 1/1971 Mito et al. ..... 419/15 X
3,890,105 6/1975 Weissman et al. ..... 419/15 X
3,964,878 6/1976 Scheithauer ..... 419/15 X

*Primary Examiner*—Stephen J. Lechert, Jr.
*Attorney, Agent, or Firm*—Spensley Horn Jubas & Lubitz

[57] ABSTRACT

Disclosed is a decorative silver-colored sintered alloy comprising TiC, $Cr_3C_2$ and Ni in amounts of 50 to 98% by weight, 1 to 20% by weight and 1 to 30% by weight, respectively, based on the three components. In this sintered alloy, TiC is present in the form of the dispersed phase of particles and $Cr_3C_2$ and Ni are present in the form of a solid solution as the binder phase. This sintered alloy is excellent in the corrosion resistance and is capable of manifesting a mirror surface having a deep silver color.

5 Claims, No Drawings

DECORATIVE SILVER-COLORED SINTERED ALLOY

BACKGROUND OF THE INVENTION (1) Field of the Invention

The present invention relates to an improvement in a decorative silver-colored sintered alloy comprising titanium carbide (TiC) as the main component. More particularly, the present invention relates to a sintered alloy which has a high corrosion resistance and is excellent in the property of manifesting a smooth mirror surface having a deep silver color. Furthermore, the present invention relates to a process for the preparation of this sintered alloy.

(2) Description of the Prior Art

A sintered alloy comprising TiC as the main component and a binder metal selected from Fe, Co, Ni, Mo, W and Ti is broadly used as a decorative material because it has a silver color and is excellent in such properties as the hardness and strength.

However, sintering of TiC per se is very difficult and in order to obtain a sinterd body having a high strength, a binder metal as mentioned above is added as a sintering aid.

Since the above-mentioned sintering aid is a metal element, corrosion of the metal component present in the sintered alloy is advanced and the color of the decorative member is readily degraded by sweat or the like.

Moreover, the sintering aid, especially the metal of the iron group, has no saitsfactory wettability with TiC, and therefore, many voids or pores appear throughout the crystals and grain boundaries in the sintered body, and even if mirror polishing is carried out, a smooth and deep mirror surface cannot be manifested.

SUMMARY OF THE INVENTION

Under this background, I made research and it was found that when chromium carbide is selected among various carbides and nickel (Ni) is selected among various metals and they are combined with titanium carbide in specific amounts and when this mixture is sintered, the foregoing defects can be eliminated and an excellent decorative silver-colored sintered alloy can be obtained. I have now completed the present invention based on this finding.

It is therefore a primary object of the present invention to provide a decorative silver-colored sintered alloy which is prominently excellent in the corrosion resistance and on which a smooth mirror surface having a deep color can be manifested.

In accordance with one aspect of the present invention, there is provided a decorative silver-colored sintered alloy, which comprises titanium carbide, chromium carbide and nickel, wherein titanium carbide is present in the form of the dispersed phase of particles in an amount of 50 to 98% by weight based on the three components, and chromium and nickel are present in the form of the binder phase of a solid solution in amounts of 1 to 20% by weight and 1 to 30% by weight, respectively, based on the three components.

In accordance with another aspect of the present invention, there is provided a process for the preparation of a decorative silver-colored sintered body, which comprises homogeneously mixing titanium carbide powder, chromium carbide powder and nickel powder in amounts of 50 to 98% by weight, 1 to 20% by weight and 1 to 30% by weight, respectively, based on the three components, compression-molding the powdery mixture in a predetermined shape, and sintering the molded body in a non-oxidizing atmosphere or in vacuum at a temperature of 1300° to 1600° C.

DETAILED DESCRIPTION OF THE PREFERED EMBODIMENTS

The sintered alloy of the present invention is in agreement with the conventional sintered alloys in that titanium carbide is the main component, but the sintered alloy of the present invention is prominently characteristic over the conventional sintered alloys in that chromium carbide is selected among carbides and incorporated in an amount of 1 to 20% by weight, preferably 5 to 15% by weight, based on the three components and nickel (Ni) is selected among binder metals and incorporated in an amount of 1 to 30% by weight, preferably 5 to 20% by weight, based on the three components.

In the preparation of the sintered alloy of the present invention, nickel as the binder metal is molten and sintering is advanced. As pointed out hereinbefore, the wettability of titanium carbide with the molten metal is poor and many pores are contained in the formed sintered body, and dents are formed on the mirror surface and the surface gloss is dull and somber. Moreover, corrosion of the metal is readily advanced by the local cell action between the binder metal and the titanium carbide particles.

Chromium carbide used in the present invention exerts the function of improving the wettability of the surfaces of titanium carbide particles with the molten metal, and chromium carbide reacts with the molten metal to form a nickel/chromium alloy excellent in the corrosion resistance in the binder metal phase. Accordingly, a sintered body having a very low pore content can be obtained according to the present invention and a smooth mirror surface having a deep silver color can be formed, and furthermore, the corrosion resistance of the sintered body is prominently improved. In order to form a phase of this nickel/chromium alloy, it is important that nickel should be used as the binder metal.

The fact that the sintered alloy of the present invention has the above-mentioned micro-structure can be easily confirmed by the analysis using an X-ray microanalyzer.

More specifically, in the sintered body of the present invention, titanium carbide is present in the form of the dispersed phase of particles and the nickel metal forms the grain boundary phase as the binder phase. The dispersed particles of titanium carbide have a size of 3 to 4 μm. All the chromium atom of chromium carbide ($Cr_3C_2$) substitutes for the nickel atom in the nickel metal crystal of the grain boundary phase of nickel and all the carbon atom of chromium carbide is included in the nickel metal crystal, with the result that a solid solution is formed. If the carbon atom is thus included in the nickel metal crystal phase, the melting point of the nickel binder phase is lowered and hence, the sintering temperature can be lowered.

In the sintered alloy of the present invention, the pore content is drastically reduced. The reason is considered to be that the wettability of titanium carbide with the binder phase is improved by the above-mentioned micro-structure of the nickel binder phase and the sintering temperature is lowered.

Chromium carbide has ordinarily a composition of $Cr_3C_2$, and chromium carbide having this composition is preferably used. However, $Cr_7C_3$ and $Cr_{23}C_6$ may be used singly or in combination with $Cr_3C_2$.

In the present invention, it is important that the above-mentioned three components should be used in specific amounts. If the amount incorporated of chromium carbide is smaller than 1% by weight, the wetting property of the metal element of TiC is not improved and the corrosion resistance is not highly improved. On the other hand, if the amount of chromium carbide is larger than 20% by weight, the sintered body becomes reddish and is not suitable as a silver-colored decorative material. The reason why the amount added of nickel is specified in the present invention is that if the amount of nickel is smaller than 1% by weight, the sintering property is degraded and a dense sintered body having a sufficient strength cannot be obtained and if the amount of nickel is larger than 30% by weight, the corrosion resistance is degraded.

It is indispensable that titanium carbide should be contained in the sintered body in an amount of at least 50% by weight, especially 50 to 98% by weight. If the amount of titanium carbide is smaller than 50% by weight, the color of the sintered body is dull silver and the sintered body is not suitable as a silver-colored decorative material. It is preferred that the amount of titanium carbide be at least 65% by weight, especially 65 to 90% by weight. Incidentally, a desirable hue can be obtained by changing the mixing ratio of each component within the above-mentioned range.

The sintered alloy of the present invention is different from the conventional sintered alloys in several points. As the sintered alloy comprising a nickel/chromium carbide solid solution as the binder, there is known a sintered alloy of the TiN—Ni—$Cr_3C_2$ system. This sintered alloy is gold-colored. The sintered alloy of the present invention is silver-colored and is different from this known sintered alloy in the hue. Furthermore, the wet angle of TiC to the binder is about 15° while the wet angle of TiN to the binder is about 113°, and the wettability is highly improved in the composition of the present invention. In the present invention, since the wettability is thus improved, the sintering property is much better than in the conventional composition, and sintering at a lower temperature becomes possible. Namely, in the present invention, sintering is possible at a temperature lower by about 100° C. than in the composition comprising TiN. Moreover, both the sintered alloys are different in the hardness of the main component used as the hard phase. Namely, the hardness (Hv) of TiN is 2050, while the hardness (Hv) of TiC is 3257. In the sintered bodies, the hardness (Hv) of TiN is 1000 to 1200, while the hardness (Hv) of TiC is 1500 to 2000.

The sintered alloy of the present invention comprises the above-mentioned three components as indispensable components. Incorporation of other components is not excluded from the scope of the present invention. For example, a part of chromium carbide may be substituted by a small amount of other carbide such as niobium carbide, and a part of metallic nickel may be substituted by other binder metal such as cobalt.

The particle sizes of starting powders of titanium carbide, chromium carbide and nickel metal may be smaller than 2.0 μm, preferably smaller than 1.0 μm.

In the process for the preparation of the sintered alloy of the present invention, chromium carbide and nickel are added to the starting powder of chromium carbide and they are homogeneously mixed, and the mixture was compression-molded and sintered. If sintered is carried out at a temperature of 1300° to 1600° C., especially 1350° to 1450° C., in a furnace of a non-oxidizing atmosphere such as nitrogen or argon or in a vacuum furnace (the vacuum degree of $10^{-2}$ to $10^{-5}$ Torr), there is obtained a decorative silver-colored sintered alloy which is excellent in the corrosion resistance and has a smooth mirror surface having a good deepness.

The present invention will now be described with reference to the following examples.

EXAMPLE 1

Starting powders shown in Table 1 were mixed and pulverized in acetone for about 68 hours, and the mixture was dried and paraffin was added in an amount of 4% by weight. Then, the mixture was compression-molded under a pressure of 1.5 ton/cm$^2$. After removal of the binder, the molded body was sintered in a vacuum furnace at a sintering temperature of 1400° C. and a vacuum degree of $10^{-4}$ Torr for 1 hour.

The so-obtained sintered alloy was mirror-polished, and the hue, specific gravity, flexural strength, Vickers hardness (Hv) and corrosion resistance were examined.

The flexural strength was measured by the three-point bending method of JIS R-1601, and the Vickers hardness was determined according to the method of JIS Z-2244. The corrosion resistance was determined by the sweat resistance test where a sample was immersed in an artificial sweat prepared from standard components of human sweat and the salt spray test where saline solution (4% w/v) was atomized and sprayed on a sample (JIS Z-2371).

The obtained results are shown in Table 1.

TABLE 1

| | Components and Mixing Ratio (% by weight) | | | | | Characteristics | | | | |
|---|---|---|---|---|---|---|---|---|---|---|
| Sample No. | TiC | $Cr_3C_2$ | carbide other than TiC and $Cr_3C_2$ | Ni | Co | apparent specific gravity | flexural strength (kg/mm$^2$) | hardness Hv (kg/mm$^2$) | corrosion resistance | hue |
| 1* | 94.5 | 0.5 | | 5 | | 4.9 | 50 | — | Δ | no silver mirror surface |
| 2* | 97.3 | 2 | | 0.7 | | 4.8 | 30 | — | Δ | no silver mirror surface |
| 3 | 93 | 2 | | 5 | | 5.7 | 90 | 2000 | O | silver white |
| 4 | 88 | 2 | | 10 | | 5.3 | 100 | 1600 | O | silver white |
| 5 | 85 | 5 | | 10 | | 5.3 | 130 | 1500 | O | silver white |
| 6 | 85 | 10 | | 5 | | 5.3 | 110 | 1900 | O | silver |
| 7* | 65 | 30 | | 5 | | 5.6 | 60 | — | Δ | no silver mirror surface |
| 8* | 50 | 15 | | | 35 | 6.2 | 110 | 1400 | X | silver |
| 9* | 90 | | | 10 | | 5.2 | 50 | — | Δ | no silver mirror surface |
| 10* | 85 | | $Mo_2C$(10) | 5 | | 5.3 | 90 | 1900 | X | silver |

TABLE 1-continued

| Sample No. | Components and Mixing Ratio (% by weight) TiC | $Cr_3C_2$ | carbide other than TiC and $Cr_3C_2$ | Ni | Co | Characteristics apparent specific gravity | flexural strength ($kg/mm^2$) | hardness Hv ($kg/mm^2$) | corrosion resistance | hue |
|---|---|---|---|---|---|---|---|---|---|---|
| 11* | 85 | | NbC(10) | 5 | | 5.3 | 80 | 1800 | X | silver |
| 12* | 93 | 2 | | | 5 | 5.7 | 80 | 1900 | X | silver |
| 13* | 88 | 2 | | | 10 | 5.3 | 90 | 1500 | X | silver |

Note
*: outside the scope of the present invention
O: good
Δ: fair
X: bad

The results obtained at the sweat resistance test showed the same tendency as that obtained at the salt spray test. In Table 1, marks "O" indicates that neither discoloration nor corrosion was caused and the sample was a decorative material having no degradation of the hue, marks "66" indicate that discoloration was caused, and marks "X" indicate that corrosion was caused in addition to discoloration, the hue was gradually degraded and the sample was not suitable as a decorative material.

As is apparent from the results shown in Table 1, discoloration or corrosion was not caused at all in sampels 3 through 6 at the corrosion test, and it was confirmed that these samples were excellent as silver-colored decorative materials. Moreover, it was found that these samples were practically satisfactory in the flexural strength.

In samples 1 and 7 where the amount of $Cr_3C_2$ was outside the range specified in the present invention, samples 2 and 8 where the amount of Ni was outside the range specified in the present invention and samples 9 through 13 outside the scope of the present invention, there could not be obtained a sintered body excellent in the corrosion resistance and the property of manifesting a mirror surface having a deep silver color.

EXAMPLE 2

A polished sintered alloy was prepared in the same manner as described in Example 1 except that a composition comprising 82.5% by weight of TiC, 10% by weight of $Cr_3C_2$ and 7.5% by weight of Ni was used.

The characteristics of the sintered alloy were determined in the same manner as described in Example 1. It was found that the apparent specific gravity was 5.3, the flexural strength was 110 $kg/mm^2$, the hardness (Hv) was 1900 $kg/mm^2$, discoloration or corrosion was not observed at the corrosion resistance test, and the hue was silver.

As is apparent from the foregoing description, the decorative silver-colored sintered alloy of the present invention has practically satisfactory hardness and strength and is capable of manifesting a mirror surface having a deep silver color excellent in the corrosion resistance, and therefore, a high decorative effect can be maintained for a long material. Accordingly, the sintered alloy of the present invention can be advantageously used as a wall material, a watch case, a brooch, a commemoration medal, a button, a bracelet, a ring, a pendant and the like.

I claim:

1. A decorative silver-colored sintered alloy, which comprises titanium carbide, chromium carbide and nickel, wherein titanium carbide is present in the form of the dispersed phase of particles in an amount of 50 to 98% by weight based on the three components, and chromium carbide and nickel are present in the form of the binder phase of a solid solution in amounts of 1 to 20% by weight and 1 to 30% by weight, respectively, based on the three components.

2. A sintered body as set forth in claim 1, wherein titanium carbide is present in the form of dispersed particles having a size of 3 to 4 μm.

3. A sintered alloy as set forth in claim 1, wherein chromium carbide has a composition of $Cr_3C_2$.

4. A sintered alloy as set forth in claim 1, wherein titanium carbide, chromium carbide and nickel are presents in amounts of 65 to 90% by weight, 5 to 15% by weight and 5 to 20% by weight, respectively, based on the three components.

5. A process for the preparation of a decorative silver-colored sintered body, which comprises homogenebusly mixing titanium carbide powder, chromium carbide powder and nickel powder in amounts of 50 to 98% by weight, 1 to 20% by weight and 1 to 30% by weight, respectively, based on the three components, compression-molding the powdery mixture in a predetermined shape, and sintering the molded body in a non-oxidizing atmosphere or in vacuum at a temperature of 1300° to 1600° C.

* * * * *